US009899010B2

(12) United States Patent
Dutton

(10) Patent No.: US 9,899,010 B2
(45) Date of Patent: Feb. 20, 2018

(54) AID FOR PLAYING A STRINGED MUSICAL INSTRUMENT

(71) Applicant: Darren Dutton, Swansea (GB)

(72) Inventor: Darren Dutton, Swansea (GB)

( * ) Notice: Subject to any disclaimer, the term of this patent is extended or adjusted under 35 U.S.C. 154(b) by 0 days.

(21) Appl. No.: 15/499,106

(22) Filed: Apr. 27, 2017

(65) Prior Publication Data

US 2017/0352336 A1 Dec. 7, 2017

(30) Foreign Application Priority Data

Jun. 1, 2016 (GB) ..... 1609593.7

(51) Int. Cl.
*G10D 3/16* (2006.01)
*A41D 19/00* (2006.01)

(52) U.S. Cl.
CPC ..... *G10D 3/163* (2013.01); *A41D 19/0024* (2013.01)

(58) Field of Classification Search
CPC ..... G10D 3/08; G10D 3/163
See application file for complete search history.

(56) References Cited

U.S. PATENT DOCUMENTS

| | | | | |
|---|---|---|---|---|
| 5,186,189 | A | 2/1993 | Harris | |
| 2007/0118968 | A1 | 5/2007 | Doty | |
| 2015/0255050 | A1* | 9/2015 | Diaz Lopez | G10D 3/163 84/322 |

FOREIGN PATENT DOCUMENTS

| | | |
|---|---|---|
| CN | 102613738 | 8/2012 |
| CN | 202566419 | 12/2012 |
| EP | 2 143 349 | 1/2010 |
| GB | 2 104 769 | 3/1983 |
| GB | 2 286 327 | 8/1995 |

* cited by examiner

*Primary Examiner* — Kimberly Lockett
(74) *Attorney, Agent, or Firm* — William H. Bollman

(57) ABSTRACT

This invention relates generally to an aid for playing a stringed instrument in the form of a glove comprising a plectrum protruding from the glove thumb tip and/or from one or more of the glove finger tips. The field of use in hand devices for playing stringed instruments. The aid for playing a stringed musical instrument, comprises: a glove with a glove thumb comprising a thumb plectrum rigidly connected to a rigid thumb portion of the glove thumb, wherein the rigid thumb portion encircles or partially encircles the glove thumb to hold the thumb plectrum snug on a thumb of the glove wearer.

16 Claims, 14 Drawing Sheets

AID FOR PLAYING A STRINGED MUSICAL INSTRUMENT

FIELD OF THE INVENTION

This invention relates generally to an aid for playing a stringed musical instrument. The aid is in the form of a glove comprising a plectrum protruding from the glove thumb tip and/or from one or more of the glove finger tips. The field of use in hand devices for playing stringed instruments.

BACKGROUND

Playing a stringed instrument involves strumming the strings of instrument. In particular, the guitar, banjo, mandolin, ukulele, for example are played by strumming or picking the strings using the finger tips and thumb tip of the user's hand.

PRIOR ART

Musicians have used their finger tips and their thumb tip to strum and pluck the strings of musical instruments.

Prior art devices in other fields such as for scratching or cleaning pet or human hair have proven to be a non-utilitarian starting point for musicians who strum or pick specific strings of a musical instrument held in special way to make musical sounds. Examples of prior art in these far fields include: US-A1-2007/118968 (Doty) discloses a scratching device for pets. GB-A-2286327 (Chang) discloses a glove for shampooing and tinting operations. U.S. Pat. No. 5,186,189 (Harris) discloses a fingernail polish protector. EP-A-2143349 (Park) discloses a glove with fingertip for picking up small objects. GB-A-2104769 (Chen) discloses protective gloves for use by hair dressers when washing hair as disclosed in the abstract.

Strumming or plucking the strings of a musical instrument in this way is painful for some musicians. Especially steel strings are painfully hard on hand tips. Thin strings for playing high notes are sharp and can cut skin on finger tips and thumb tips.

Picks are known in the prior art for strumming or plucking the strings without contacting the strings with the finger tips or thumb. A pick comprises a plectrum for strumming or plucking the strings.

A simple pick is simply a planar flat chip of hard plastic or metal known as a plectrum. A musician holds the simple pick between the thumb and index finger as they strum or pluck the strings. The simple pick must be constantly squeezed between the index finger and the thumb which is tiresome. It is easily dropped which is annoying and in public performances embarrassing.

The prior art also knows a pick comprising a plectrum fixed rigidly to a finger ring or a thumb ring. It overcomes the problem of the simple pick because a musician places the ring snugly on their finger. The musician does not have to actively hold the pick so they do not accidentally drop it.

Devices disclosed in the prior art including publication CN-A-102613738 (University Sichuan) and CN-U-202566419 (Chen) partially overcome some of these problems, but do not provide the musician enough control to practically strum or pick the strings.

A pick comprising a finger or thumb ring must be placed individually on each finger and on the thumb. The ring must be turned to the musician's preferred position on each finger and the thumb to orientate the plectrum so that the musician can strum or pluck the strings as they are accustomed. The ring must also be pushed along each finger or thumb to the musician's preferred longitudinal position. If the musician wants to strum or pluck the strings without plectrum, but rather with their finger or thumb to get a softer sound, they must do so a part of their bare finger or thumb.

The present invention overcomes painful and inconvenient drawbacks to playing a stringed instrument known in the prior art.

SUMMARY OF THE INVENTION

According to a first aspect of the present invention, an aid for playing a stringed musical instrument comprises: a glove adapted to be worn over a user's thumb and at least one finger, the glove has a first rigid portion having a first rigid connection means for a first plectrum, the first rigid portion at least partially encircles the user's thumb or finger when worn.

As a musician pulls the glove onto their hand the glove is set into a preselected orientation with respect to the musician's thumb and finger. The first connection means is thereby also set into a preselected position. The rigid connection means connects the first plectrum rigidly to the first rigid portion in the preselected position. The musician is ready to play their instrument with the plectrum in the correct position on their hand for playing when the put the glove on and connect the first rigid plectrum to it.

Preferably the aid comprises the first plectrum either as kit including the glove and plectrum or as a single unit wherein the glove comprises the first plectrum connected by the first rigid connection means to the first rigid portion.

Preferably the aid has a second rigid portion having a second rigid connection means for the first plectrum or a second plectrum, wherein the second rigid portion at least partially encircles the at least one the finger and the first rigid portion at least partially encircles the thumb.

Preferably the aid comprises the second plectrum either as kit including the glove and plectrum or as a single unit wherein the glove comprises the second plectrum rigidly connected by the second rigid connection means to the second rigid portion.

The musician has a choice of playing the instrument with the instrument with the plectrum attached to their thumb in a preselected position or attached to their finger in a preselected position.

Preferably the aid comprises the first and second plectrum either as kit including the glove and first and second plectrums or as a single unit with the first and second plectrums connected to the glove by the first and second rigid connection means respectively.

Preferably the glove comprises a first digit which is a finger or the thumb of the glove.

Preferably the first digit comprises the first rigid portion and the first rigid connection means rigidly connecting the first plectrum to the first rigid portion.

Preferably the rigid first portion comprises a first clip to encircle or partially encircle a user's finger or thumb, preferably when inserted into the first digit to hold the first plectrum snugly thereon the user's finger or thumb.

Preferably, wherein the first digit is the thumb, the aid comprises a second digit which is a finger of the glove, the second digit comprising a second connection means rigidly connecting a second plectrum to a rigid second portion of the second digit, wherein the rigid second portion comprises a second clip to encircle or partially encircle the user's finger insertable into the second digit to hold the second plectrum snugly thereon and in position relative to the first plectrum.

Preferably the first rigid portion and second rigid portions comprise first and second clips respectively; the clips including free ends of the ring portion by which the first and second rigid portions are in use held tight to the user's thumb and finger.

According to a second aspect of the present invention there is an aid for playing a stringed musical instrument, comprising: a glove with a glove thumb comprising a thumb plectrum rigidly connected to a rigid thumb portion of the glove thumb, wherein the rigid thumb portion encircles or partially encircles the glove thumb to hold the thumb plectrum snug on a thumb of the glove wearer. Preferably the aid is in the form of the glove.

Advantageously with all embodiments as a musician pulls the glove onto their hand, a plectrum when rigidly connected to a rigid portion is positioned on the musician's hand for strumming, picking, or plucking strings of a musical instrument to play the instrument.

Preferably at least one finger of the glove comprises a finger plectrum rigidly connected to a rigid finger portion of the glove finger, wherein the rigid finger portion encircles or partially encircles the glove finger to hold the finger plectrum snug on a finger of the glove wearer and in position relative to the thumb plectrum. Advantageously when the musician puts the glove onto their hand, both the thumb plectrum and the finger plectrum are positioned on the musician's hand for strumming, picking, or plucking strings of a musical instrument to play the instrument.

Preferably in embodiments wherein the rigid thumb portion and/or the rigid finger portion partially encircles the glove thumb and/or the glove finger, the rigid portion encircles an angle of at least 140 degrees to provide a good grip on the glove wearer's more thumb and/or finger. More preferably the rigid portion encircles an angle of at least 180 degrees and grips the thumb and/or finger from side to side. Preferably the rigid portion spans an angle of at least 270 degrees to allow the musician to pluck the strings and knock the strings along an edge of the plectrum.

Preferably the first rigid portion and second rigid portion comprise a first and a second component of a clasp respectively for holding the thumb and finger at least partially encircled by the rigid portions tip to tip.

Preferably the glove includes a first digit for the thumb comprising the first rigid portion and a second digit for the index finger comprising the second rigid portion, and the first digit and second digits comprise a first and a second component of a clasp respectively for holding the first and second digits clasped tip to tip.

Preferably the at least one finger of the glove includes the index finger, and the thumb print side of the glove thumb tip comprises a first component of a clasp and the glove index finger tip comprises a second component of a clasp, to hold the glove thumb tip and index finger tip clasped tip to tip. So clasped, the index finger plectrum is held clasped out of the way of strings of the musical instrument as the strings are strummed with the thumb plectrum.

Hence preferably wherein the second digit is the index finger and, and the thumb print side of the first digit comprises a first component of a clasp and the tip of the second digit comprises a second component of the clasp, to hold the first and second digits clasped tip to tip.

Preferably the thumb plectrum and/or the finger plectrum comprise a hinge for folding the plectrum back toward the glove thumb and/or glove finger respectively. The thumb plectrum folded when folded is out of the way of the strings as the musician strums the strings. The finger plectrum when folded is also out of the way of the strings. Preferably the thumb and/or finger plectrum comprises a latch for locking the plectrum in the extended position for strumming the strings.

Preferably the glove comprises a means for a musician to connect and to disconnect the thumb plectrum and/or finger plectrum from the glove thumb and/or glove finger. Advantageously the plectrum may be replaced if it breaks.

Preferably the plectrum has an edge which connects the plectrum to the glove thumb and/or glove finger. Preferably the edge is an edge of the flat planar portion of the plectrum. Preferably the means to connect/disconnect the plectrum to the glove is arranged to disconnect the plectrum by displacement parallel to the edge because strumming and picking the strings moves the plectrum perpendicular to the edge, thereby preventing unintended disconnection of the plectrum from the glove.

Preferably, the rigid portion is attached to the exterior of a flexible portion which is preferably a flexible layer of material which forms the glove. Preferably the material is stretchable to stretch tightly onto the user's hand including the user's thumb and finger at least partially encircled by the rigid portion(s) so as to snugly attach the plectrum to the user's playing hand via the rigid portion and rigid connection means. Suitable materials include but are not limited to cloth, polymeric film, and genuine and artificial skin such as leather.

Preferably the aid comprises a slot through the flexible layer though which the plectrum passes when connected to the rigid connection means. Preferably the aid comprises a first slot through the flexible portion of the thumb of the glove. Preferably the length and width of the first slot are suitable for a slip fit for thumb plectrum to pass through, whereby the thumb plectrum passes through the first slot and connects to the rigid thumb portion.

Preferably the first slot is aligned with the longitudinal direction of the glove thumb.

Preferably the first slot is located in the opposite side of the glove thumb from the glove fingers.

Preferably the aid comprises a first slot through a flexible portion of the glove finger for the finger plectrum to pass through and connect to a rigid portion of the finger.

Preferably the aid comprises a second slot through a flexible portion of the finger of the glove. Preferably the length and width of the second slot are suitable for a slip for the finger plectrum to pass through, whereby the finger plectrum passes through the first slot and connects to the rigid finger portion.

Advantageously the aid may be manufactured from components one of which is a flexible glove.

Preferably the connection means comprises a groove in the rigid first portion to receive the first plectrum. Preferably the groove in the first portion is aligned with the longitudinal direction of the first digit.

Preferably the means for a musician to connect and to disconnect the thumb plectrum is a first groove in the rigid thumb portion. Preferably the length and width of the first groove are such that the rigid thumb portion receives and holds the thumb plectrum so that the thumb plectrum is rigidly connected to the rigid thumb portion.

Preferably the first clip is adapted to align the groove in the first rigid portion with the longitudinal direction of the user's thumb or finger when the clip is holds the first rigid portion snugly thereon.

Preferably when the glove comprises the first rigid portion arranged to at least partially encircle the user's thumb, the first plectrum when connected to the first rigid portion extends in a plane parallel to the plane of the glove when the glove is open flat.

Preferably the means for a musician to connect and to disconnect the finger plectrum is a second groove in the rigid finger portion. Preferably the length and width of the second groove are such that the rigid finger portion receives and holds the finger plectrum so that the finger plectrum is rigidly connected to the rigid finger portion.

Preferably the first groove is aligned with the longitudinal direction of the glove thumb and the second groove is aligned with the longitudinal direction of the glove finger. Preferably each groove is arranged to receive the edge of the plectrum which connects the plectrum to the glove.

Preferably the first plectrum extends from a side of the first digit.

Preferably the first plectrum extends from in a plane parallel with the longitudinal direction of the first digit.

Preferably, wherein the first digit is the thumb, the first groove is located in the opposite side of the glove thumb from the glove fingers when the glove is open flat.

Preferably wherein the first digit is the thumb, the first plectrum extends from the first digit away from the glove index finger when the glove is open flat. Preferably the first plectrum extends in a plane parallel to the plane of the glove when the glove is open flat.

Advantageously the thumb plectrum is thereby in an ideal position when the glove is pulled on to a musician's hand for strumming or plucking strings of a stringed instrument to play the instrument. Advantageously the first slot or first groove is aligned and located to facilitate the thumb plectrum being fixed to an ideal position of the thumb with ideal alignment for playing the instrument.

Preferably, wherein the second digit is a finger of the glove, the second plectrum extends from the tip of the second digit in the longitudinal direction of the second digit. Preferably the second plectrum, which is a finger plectrum, extends in a plane parallel to the plane of the glove when the glove is open flat. Advantageously both the first plectrum, which is the thumb plectrum, and second plectrum, which is the finger plectrum, are thereby simultaneously both held in an ideal position on a musician's thumb and finger when the glove is pulled on to the musician's hand. The musician has only to pull the glove onto their hand to be ready to strum or pluck strings of a stringed instrument to play the instrument with both the thumb plectrum and the finger plectrum.

Preferably the thumb plectrum is rigidly connected to a thumb pick ring portion. Preferably the thumb pick ring portion is the rigid thumb portion. Preferably the finger plectrum is rigidly connected to a finger pick ring portion. Preferably the finger pick ring portion is the rigid finger portion.

Preferably the rigid thumb portion is rotatable about the longitudinal axis of the glove thumb with respect to a flexible portion of the glove thumb. Preferably the rigid finger portion is rotatable about the longitudinal axis of the glove finger with respect to a flexible portion of the glove finger. In this manner, the thumb plectrum and/or the finger plectrum is rotatable about the longitudinal axis of the thumb and/or the finger. So advantageously of a musician who wears the glove so that they may position the thumb plectrum and/or the finger plectrum for their own accustomed style of playing a stringed instrument.

Preferably the glove comprises a flexible portion connected directly to the rigid thumb portion and/or the rigid finger portion. Preferably the flexible portion and the rigid thumb portion and/or the rigid finger portion are integrally formed together.

In preferred embodiments, the rigid portion of the glove thumb and/or glove finger are internal to the glove or attached an internal surface of a flexible portion of the glove.

In some embodiments, the rigid and flexible portions of the glove are integrated such that the plectrum engages directly with the rigid portion without having to pass through a flexible portion of the glove. Preferably the rigid portion is external to the flexible portion so that the flexible portion provides a layer of comfortable material between the musician's hand the rigid portion.

Preferably the glove comprises a means whereby the position of the thumb plectrum and/or finger plectrum is adjustable by the musician. Preferably the means provides a method for adjusting how much the plectrum protrudes from the glove and for adjusting the orientation of the plectrum relative to the glove thumb and/or glove finger.

Preferably the means for adjusting how much the plectrum protrude includes a means to adjust how far into the groove the plectrum rests. Preferably indentations and matching bumps on the plectrum and of the groove provide detents for the musician to select a preferred amount the plectrum protrudes from the glove finger-tip and/or glove thumb tip. Advantageously this adjustability of the amount of protrusion accommodates musicians with various and conformations and levels of dexterity.

Preferably the aid is in form of kit of parts comprising the glove and the thumb plectrum and/or the finger plectrum.

Preferably the clip comprises a ring or thimble. Preferably the rigid portion comprises the ring or thimble. Preferably the clip is included in the thimble. Preferably, the ring is a split ring having a split circumference. Preferably, wherein the first digit is the thumb, the rigid first portion is integral with the first plectrum. Preferably the first connection means is integral of the rigid first potion and the first plectrum. Preferably the first plectrum is comprised with the clip which is preferably a thumb pick ring which has a diameter slightly larger than the diameter of the inside of a flexible layer of the first digit, which is the glove thumb. So preferably the clip which is the thumb pick ring is arranged to be seated inside the flexible layer of the glove thumb. The rigid first portion comprises the rigid thumb portion.

Preferably the finger plectrum is comprised with a finger pick ring which has a diameter slightly larger than the diameter of the inside of one of the glove fingers so that the pick ring is arranged to be seated inside the glove finger as to form the rigid finger portion.

The thumb pick ring and finger pick ring have an inner diameter surface for fitting snuggly onto the musician's thumb and finger as they wear the glove.

According to another aspect to the invention there is a method of manufacture of an aid for playing a stringed musical instrument assembled from a thumb plectrum which extends from a thumb ring or a thimble, and a glove; wherein the aid is manufactured by making a thumb slot through the thumb of the glove, inserting thumb ring or thimble into the glove so that the thumb plectrum pokes through the thumb slot, and seating the ring or thimble into to the tip of the thumb of the glove. Preferably the thumb slot is made through a flexible portion of the thumb of the glove. Preferably by so assembling the aid, the aid is made to conform with the first aspect of the invention.

According to another aspect of the invention there is a method for manufacture of an aid for playing a stringed musical instrument, including: selecting a glove with a first digit which is a finger or the thumb of the glove; and a rigid first portion rigidly connected to a first plectrum by a first connection means, wherein the rigid first portion comprises a clip to snugly encircle or partially encircle a user's finger or thumb; inserting the rigid first portion, first plectrum and first clip into the first digit; and poking the first plectrum through the first digit.

Advantageously the aid is very inexpensive to manufacture. A glove with a flexible layer of skin or cloth is inexpensive. The rigid portion, first plectrum, first connection means, and first clip are an inexpensive integral unit which may be formed by moulding polymer or metal/metal alloy or by bending a strip of polymer or metal/metal alloy. The aid is inexpensively made by inserting the integral unit into the glove digit where the integral unit is fixed to the flexible layer proximate the tip of digit with plectrum poking through the flexible layer.

According to another aspect of the invention there is a method of manufacture of an aid for playing a musical stringed instrument, including: selecting a glove with a first digit which is a finger or the thumb of the glove; and a rigid first portion comprising a first connection means, wherein the rigid first portion comprises a first clip to snugly encircle or partially encircle a user's finger or thumb; inserting the rigid portion, first connection means, and first clip into the first digit; and rigidly connecting a first plectrum to the rigid first portion by poking the first through the first digit into the first connection means.

Advantageously the aid is very convenient for the musician. The musician gets a glove with the rigid portion fixed to the flexible layer of the digit. The musician can practice playing the instrument whilst earing the glove.

In use the musician removes the plectrum by detaching it from the connection means. For a connection means which is groove in the rigid portion, the musician removes the plectrum by pulling it out of the groove. In use the musician removes from the connection means a plectrum which is worn out or broken. In use musician also remove the plectrum if they just want to replace it with one that has different dimensions, roughness, or other property that helps them play the instrument a certain way. In use the musician attaches a new plectrum by poking it through the flexible layer of cloth or skin of the glove first digit. For a connection means which is a groove, the musician inserts the plectrum into the groove of rigid portion to rigidly connect the plectrum to the rigid first portion. The musician can even connect the plectrum using their free hand while wearing the glove on their other hand.

Preferably the thumb slot is made through the thumb of the glove so that the slot is aligned with the longitudinal direction of the thumb.

Preferably the thumb slot is made though the thumb on the opposite side of the thumb from the fingers.

Preferably a flexible layer of cloth or skin which forms a flexible layer of the glove stretches over the rigid portion fixing the rigid portion to the interior surface of the flexible layer. Preferably the rigid portion is thereby rigidly connected to the digit. More preferably the flexible layer stretches over the clip.

Preferably as the aid is made, the thumb of the glove is stretched over the thumb ring or thimble where the thumb ring is seated in the tip of the thumb of the glove.

Preferably the method of manufacturing the aid includes further assembly from a finger plectrum which extends from a finger ring or thimble, by making a finger slot through at least one finger, inserting the finger ring into the glove so that that the finger plectrum is poked through the finger slot, and seating the finger ring or thimble into the tip of the finger of the glove. Preferably the slot is made through a flexible portion of the glove. Preferably by so assembling the aid, the aid is made to conform with the specification of the aid herein described.

Preferably the finger slot is made in the tip of the finger such that the finger plectrum extends longitudinally from the tip of glove finger in a plane parallel to a glove wearer's finger nail and parallel the plane of the glove in the open position.

Preferably as the aid is made the finger of the glove is stretched over the finger ring.

Preferably the rigid portion comprises an internal module and an external module. The internal module is fixed to an interior surface of the glove flexible layer. The external module is rigidly connected to the internal module by a modules connecting means.

Preferably the modules connecting means comprises a portion of the internal module which penetrates through the flexible layer.

Preferably the external module comprises the first rigid connection means for the first plectrum.

Preferably the internal module comprises the ring portion to hold the joined modules as a single rigid portion to the user's thumb or finger in use.

Preferably the internal module comprises the clip as part of the ring portion whereby the plectrum is held fast by the clip to the user's thumb or finger.

Preferably the rigid portion comprises an internal module over which the flexible layer of cloth or material is stretched, and an external module exterior to the flexible layer and rigidly connected to the internal module, wherein the external module comprises the first rigid connection means.

The invention will now be described, by way of example only, with reference to the accompanying drawings in which:

BRIEF DESCRIPTION OF THE FIGURES

FIG. 15C is a view of a user's thumb to be inserted into the internal module.

DETAILED DESCRIPTION OF THE INVENTION

Figure 1:
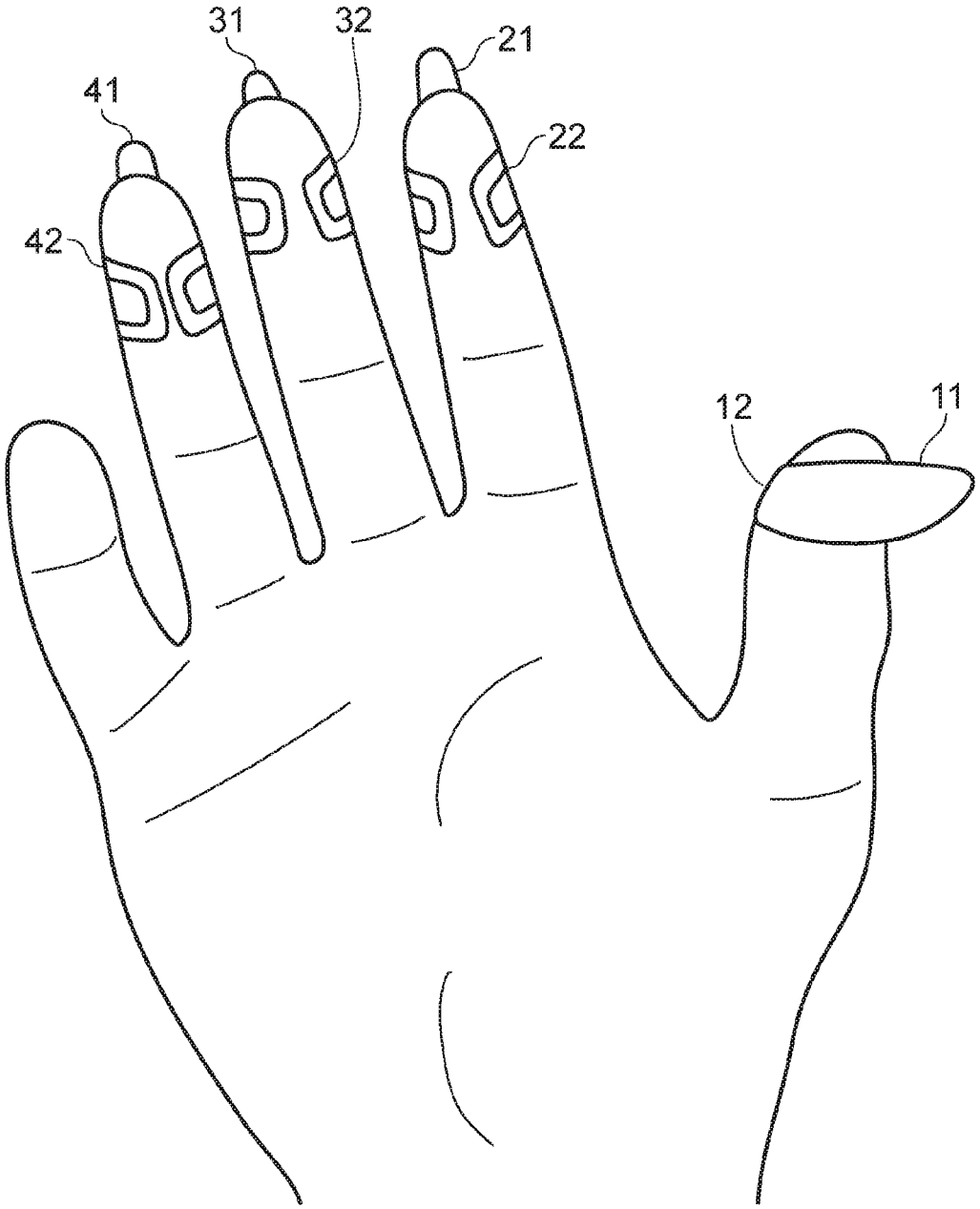
FIG. 1 is a view of thumb pick known in the prior art and three finger picks known in the prior art shown as worn on a palm on a hand facing palm up.

Referring to the Figures, there is shown in FIG. 1 a hand of a person facing palm up. The hand of the person is shown facing palm down in FIG. 2. Worn on the thumb of the hand is a thumb pick for strumming or picking strings of a stringed instrument. Worn on the index finger, the middle finger, and the ring finger are finger picks.

Figure 2:
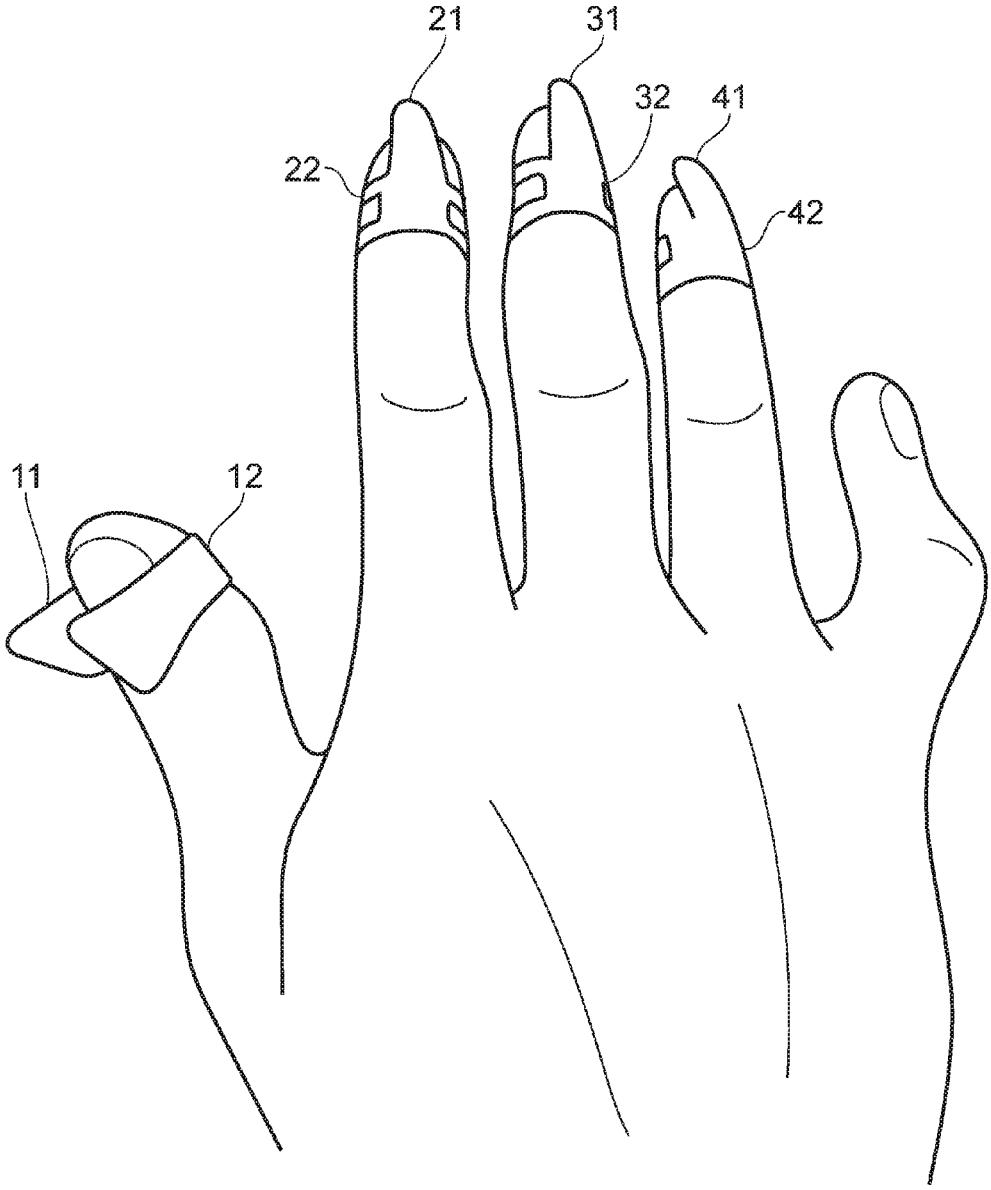
FIG. 2 is a view of a thumb pick known in the prior art and three finger picks known in the prior art shown as worn on a palm of a hand facing palm down.

The thumb pick shown in FIGS. 1 and 2 is a type known in the prior art, and it comprises a thumb pick plectrum 11 which is rigidly connected to a thumb pick ring portion 12. The thumb pick plectrum is rigidly connected to the thumb pick ring portion by means of them being integrally formed together.

The finger picks shown in FIGS. 1 and 2 are a type known in the prior art. They each comprise a finger pick plectrum 21, 31, 41 which is rigidly connected to a finger pick ring portion 22, 32, 42.

The thumb pick known in the prior art and the finger picks known in the prior art must each be put separately onto each individual finger and the thumb of the hand of the person who wears them. They must be individually rotated around the long axis of the finger or thumb on which they are worn to place them in the proper position for playing the instrument.

Figure 3:
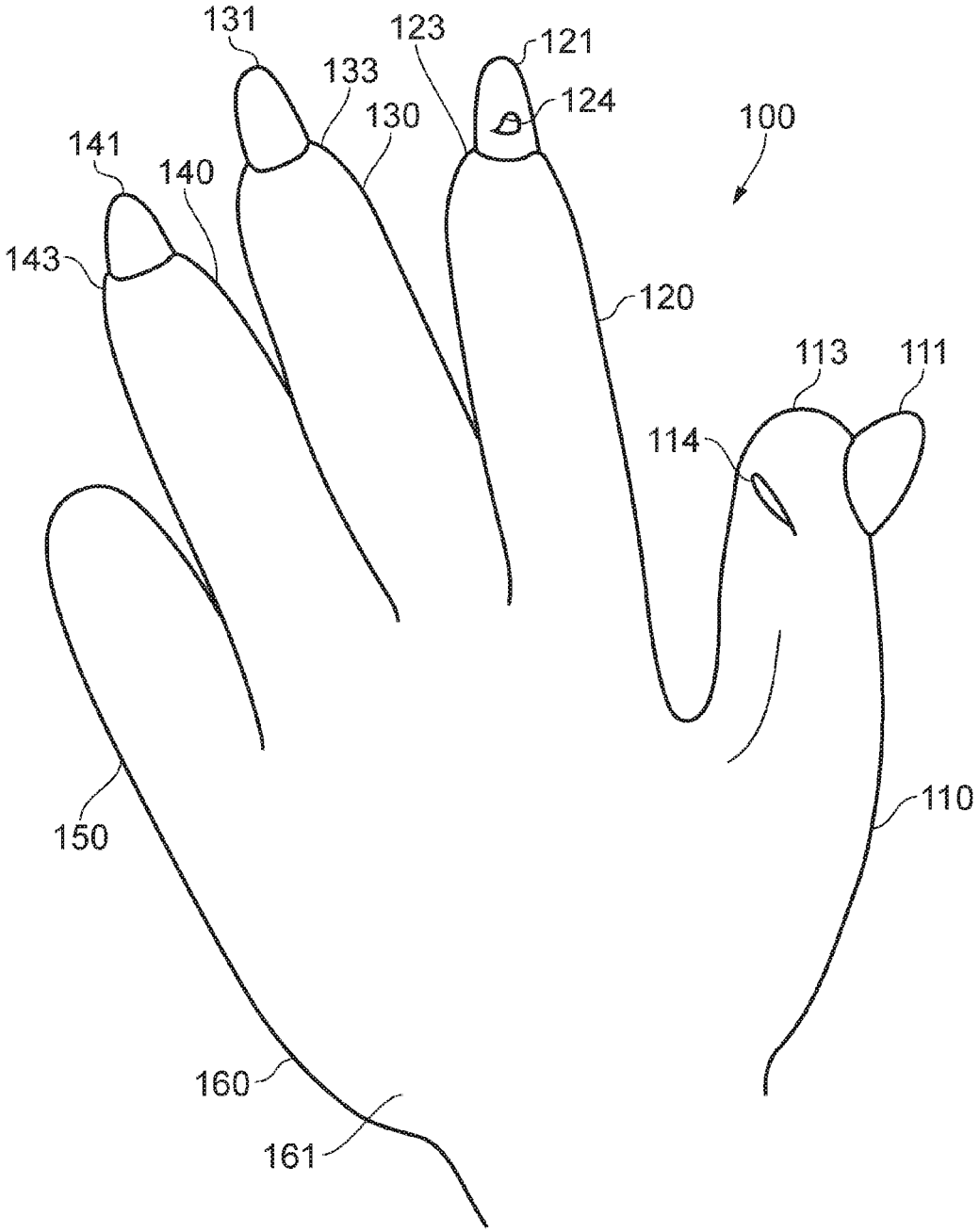
FIG. 3 is a view looking at fingertips of an aid for playing a stringed instrument according to the invention.

FIG. 3 shows is a view of an aid 100 for playing a stringed instrument according to an invention. The aid comprises a glove 160 having a palm 161 and four fingers: a pinky 150, a ring finger 140, middle finger 130, and index finger 120. FIG. 3 shows the glove palm up and looking toward the finger tips.

Figure 4:
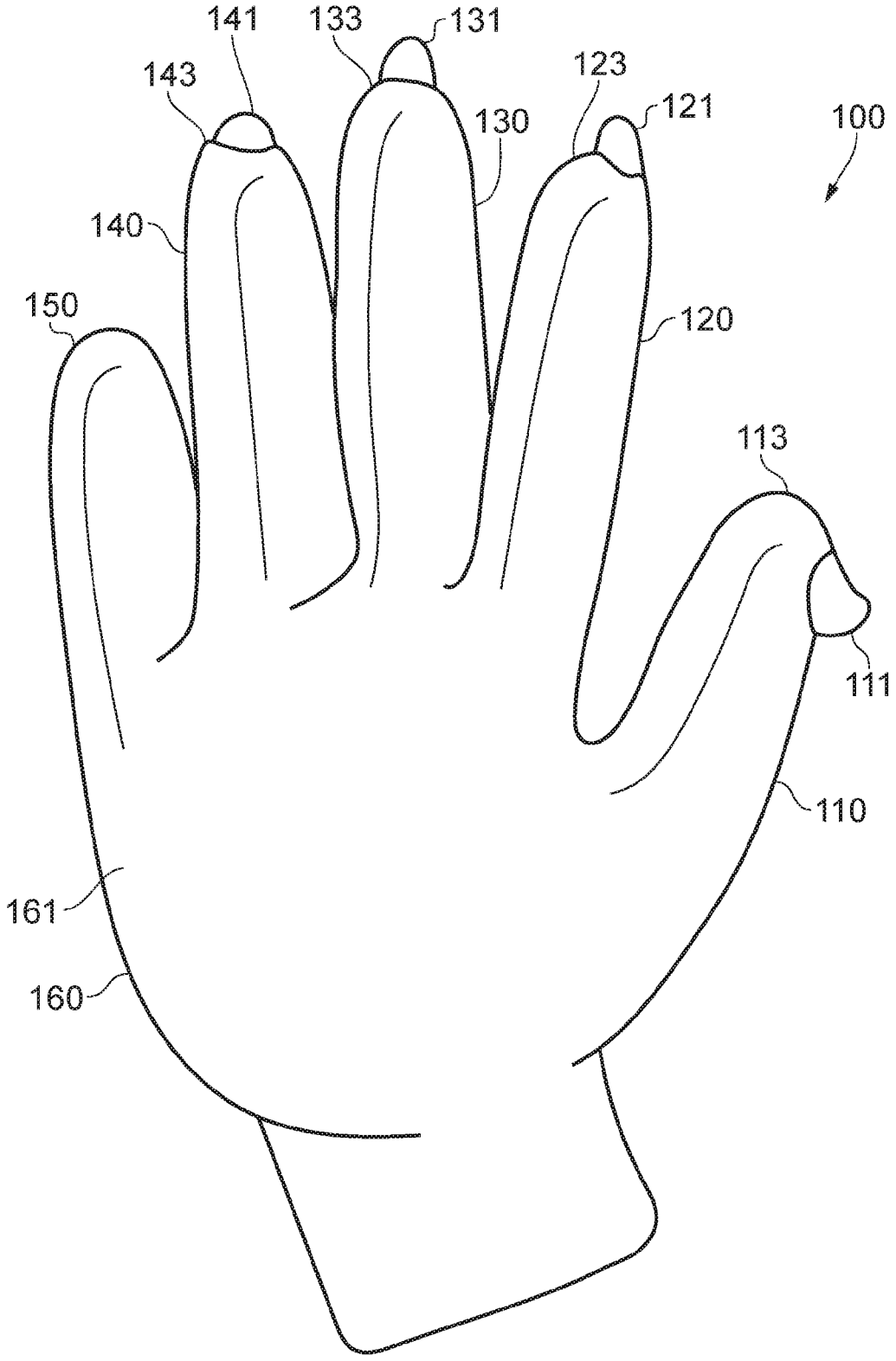
FIG. 4 is a palm up view of an aid for playing a stringed instrument according to the invention.

FIG. 4 shows a second view of the aid 100 with the palm 161 of the glove 160 facing upwards.

Figure 5:
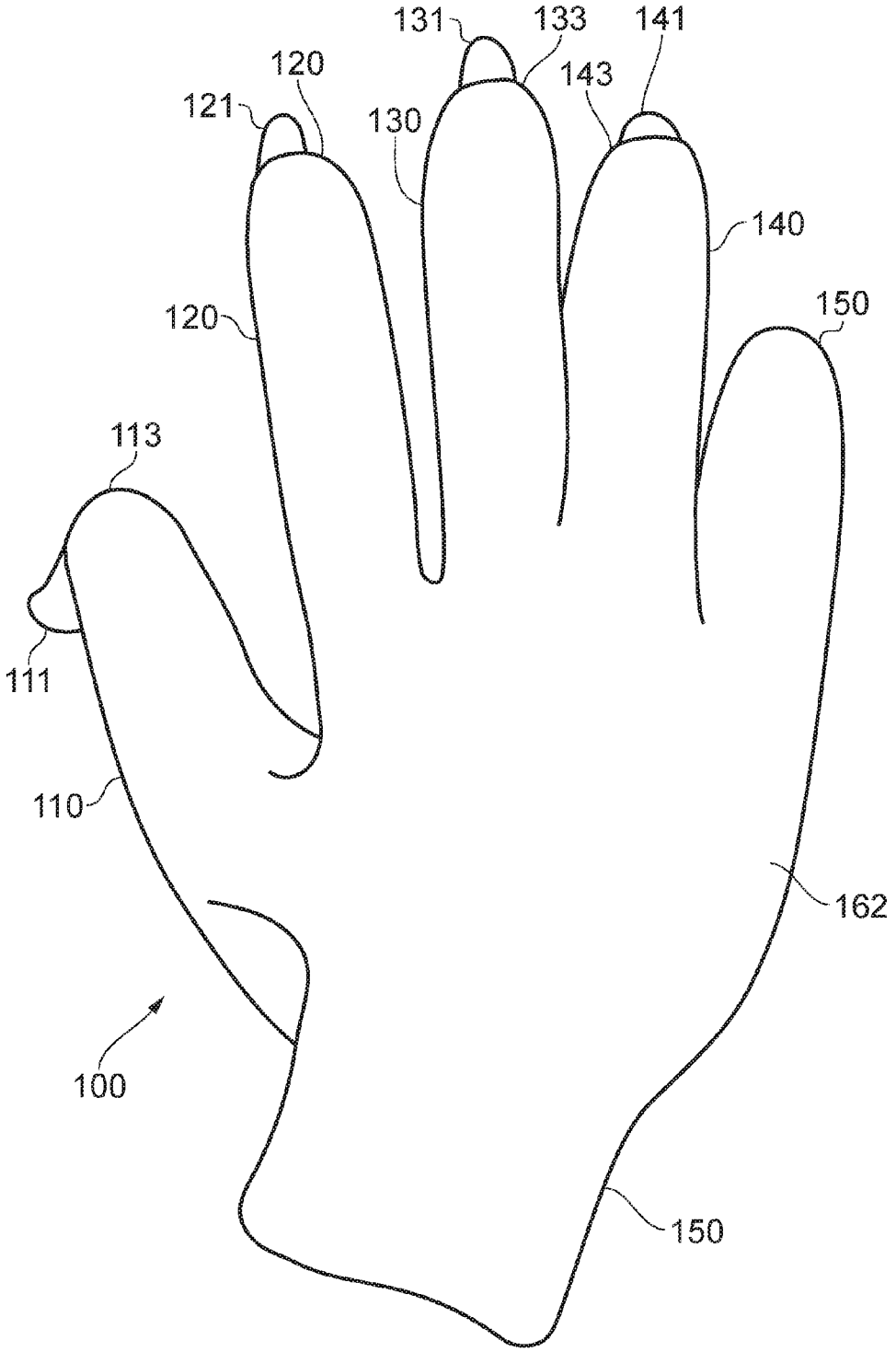
FIG. 5 is a palm down view of the back side of an aid for playing a stringed instrument according to the invention.

FIG. 5 shows a third view of the aid 100 with the back side 162 of the glove 160 facing upwards.

FIGS. 3, 4, and 5 show an aid for playing a stringed musical instrument, comprising: a glove 160 with a first digit which is a finger (index finger 120, middle finger 130, ring finger 140, little finger 150) or the thumb 110 of the glove, the first digit comprising a first connection means. The first connection means is not shown because it is hidden inside the flexible skin or cloth layer of the first digit.

The first connection means rigidly connect a first plectrum to a rigid first portion of the first digit. The first plectrum is the thumb plectrum 11 when the first digit is the thumb 110. It is the index finger plectrum 121 when the first digit is the index finger 120. It is the middle finger plectrum 131 when the first digit is the middle finger 130. The first plectrum is the ring finger plectrum 141 when the first digit is the ring finger 140.

Figure 6:
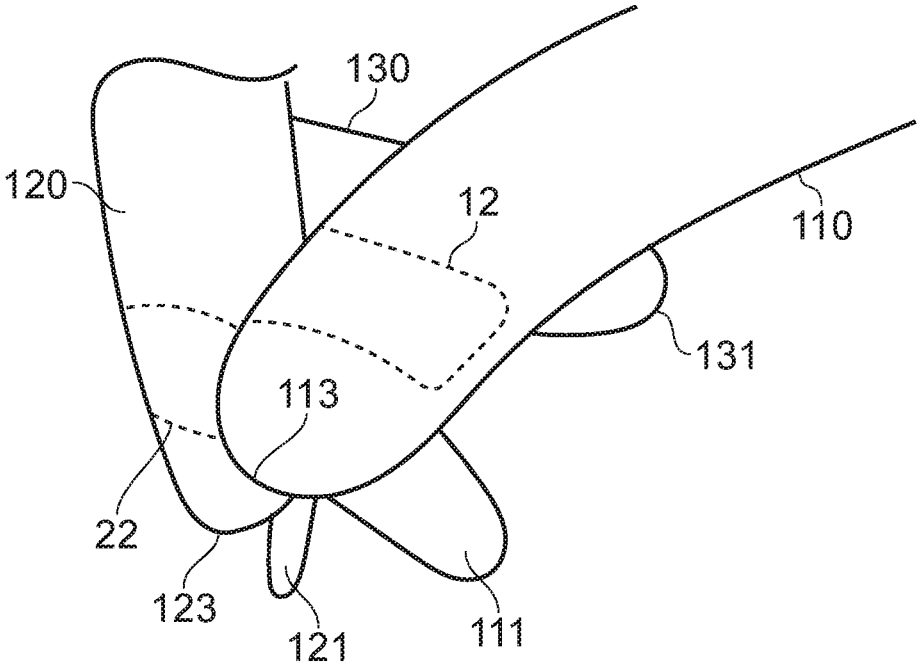
FIG. 6 is a view of the aid for playing a stringed instrument with index finger pinched against thumb according to the invention.

The rigid first portion comprises a first clip 12, which is shown by a dashed line in FIG. 6 since it is hidden under the flexible skin or cloth layer of the first digit 110. The clip 12 is a ring with a split circumference and partially encircles a user's thumb when inserted into the first digit 110 to hold the first plectrum 111 snugly thereon.

In the illustration of FIG. 6, the first digit 110 is the thumb.

In the example of FIG. 6 the first plectrum 111, the rigid first portion, the first connection means, and the first clip 12 are all an integral unit formed from a thin bent or moulded strip of metal or polymer. The thin strip is hard and stiff enough to make for a rigid first plectrum 111 and first connection means. The first connection means integrally transitions to the first clip 12. Thin strip is resilient and springy enough to allow the split ring of the first clip 12 to clip to the users thumb and snugly hold the first plectrum 111 thereon.

The glove also comprises a second digit 120 which is the index finger 120 of the glove.

The second digit 120 comprises a second connection means which is not visible in the Figures. The second connection means rigidly connects a second plectrum 121 to a rigid second portion of the second digit.

The second plectrum 121, the rigid second portion, the second connection means, and the second clip are all and integral unit formed as the described for the first plectrum 121, the rigid first portion, the first connection means, and the first clip. A thumb pick plectrum 111 is located proximate the tip 113 of the thumb of the glove. The plectrum 111 is a flat chip of hard polymeric material or metal.

The thumb pick plectrum 111 extends in a direction away from the index finger 120 which is on the opposite side of the thumb 110.

As shown in FIGS. 3, 4, and 5 when glove is in the open position the fingers, thumb, and palm lies in a substantially flat plane. The glove thumb pick plectrum 111 also lies in the same plane.

In an embodiment, the thumb pick plectrum 111 is connected to a thumb pick ring portion. The thumb pick ring portion cannot be seen in FIG. 3, 4, or 5 because it is inside the thumb of the glove. The thumb pick ring portion is seated against an inner surface of the glove inside the thumb of the glove. The thumb pick plectrum 111 protrudes through a slot 115 in the thumb of the glove.

A person pulls the glove 160 onto their hand to play a stringed instrument. As they pull the glove onto their hand, their thumb is inserted into the thumb of the glove. The thumb pick ring portion is seated inside the thumb 110 of the glove. The thumb pick ring portion is also pulled onto the person's thumb. The person is then ready to play the stringed instrument because the thumb pick plectrum 111 is already extending from the person's thumb in the proper direction for playing the instrument. The thumb pick plectrum 111 is set at the proper direction by virtue of pulling the glove onto the hand.

An embodiment of the aid 100 for playing a stringed instrument comprises the glove 160 and a thumb pick comprising a thumb pick ring portion 12 and a thumb pick plectrum 11. In this embodiment the aid may be supplied as a kit comprising the glove and the thumb pick.

The glove thumb 110 comprises a plurality of parallel slots. Each slot length and width so that the thumb pick plectrum may slide through each slot. The parallel slots are aligned lengthwise with the long axis of the thumb. The slots are located the side of the glove thumb which is opposite and furthest away from the index finger 120 of the glove.

The thumb pick plectrum 11, 111 pokes through the slot 115 in the thumb. So, each one of the parallel slots allows the plectrum to poke through at a different angle with respect to the plane of the glove 160 in the open position. Each individual person prefers to hold the plectrum 11, 111 at an angle which they are comfortable with strumming or picking the strings. So, providing a plurality of parallel slots side by side through the thumb 110 allows each person to place the thumb pick into the thumb 110 of the glove 160, and to insert the thumb pick plectrum 11, 111 of the thumb pick through the one of the slots which they choose according to their preferred style of play.

Figure 8:
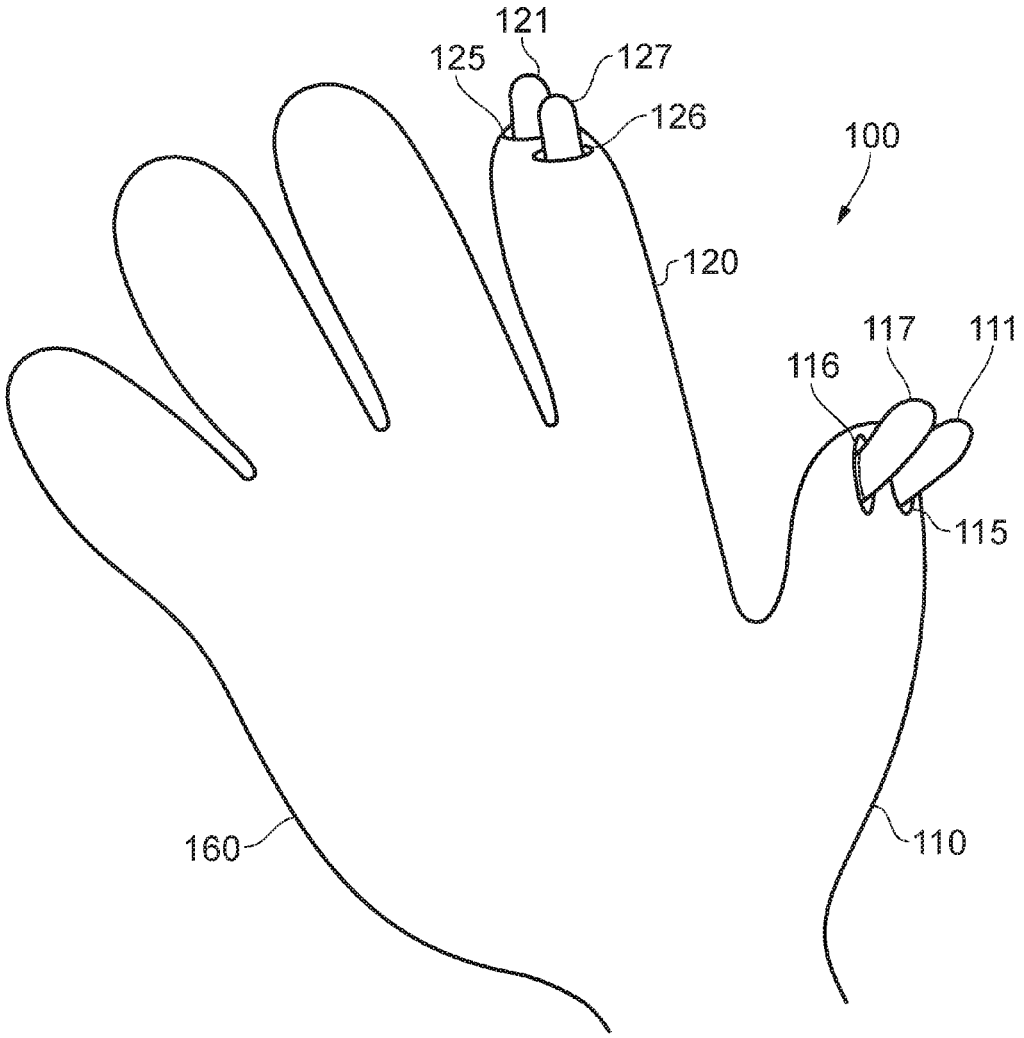
FIG. 8 is a palm up view of the aid for playing a stringed instrument comprising a pair of thumb pick plectrums and a pair of index finger pick plectrums.

In an embodiment shown in FIG. 8, a second thumb pick plectrum 117 which is parallel to the first thumb pick plectrum 11, 111 also pokes through a second slot 116 in the glove thumb 110. In an embodiment, the second thumb pick plectrum 117 is rigidly fixed to the thumb pick ring 12 and the thumb pick ring, which is a rigid component is attached to an inner surface of a flexible portion of the glove.

The thumb of the glove has an inside diameter which is less than the diameter of the thumb pick ring portion. Hence when the thumb pick is inserted into the thumb 110 of the glove so at to poke the thumb pick plectrum 11 through one of the slots though the thumb, the thumb pick ring portion is held tightly by the thumb of the glove. The thumb of the glove comprises an elastically resilient material which stretches over the thumb pick ring portion.

In another embodiment, the thumb 110 of the glove comprises a rigid portion proximate the tip 113 of the glove. The rigid portion encircles or partially encircles the thumb of the glove. The diameter of rigid portion that of the thumb of the glove. Hence when a person pulls the glove onto their hand, the rigid portion grips the person's thumb.

In one embodiment, the rigid portion of the thumb is thimble shaped and forms the tip 113 or a portion of the tip of the thumb 110 of the glove. In another embodiment, the rigid portion is ring shaped or has the shape of a split ring that even though made of rigid material the diameter of the is expandable by a person's thumb as it is insert into the thumb 1110 of the glove.

The thumb pick plectrum 111 is fixed to the rigid portion. In an embodiment, the thumb pick plectrum 111 is held in a groove in the rigid portion. In an embodiment, the plectrum 111 is detachable from the groove and thereby detachable from the glove. So another thumb pick plectrum may be inserted and held in the groove. This allows for breakage of a thumb pick plectrum or replacement of one with a different hardness to achieve certain playing tone.

The glove finger tips and glove thumb tip comprise a high friction material for gripping the plectrum to give a musician peace of mind that the plectrums will not disengage inadvertently from the grooves which fix them to the glove while they are playing the instrument.

FIGS. 3, 4, and 5, show an index finger plectrum 121 which extends from the tip 123 of the glove index finger 120. The index finger plectrum is a substantially flat planar chip of hard plastic or metal. The index finger plectrum 121 extends in the direction of the longitudinal axis of the index finger like a long fingernail In one embodiment, the index finger 120 of the glove has a tip 123 comprising a rigid material. In one embodiment, the rigid material is thimble shaped, in another embodiment it is ring shaped. In one embodiment, the rigid material has a separation or split through the rigid material. The split or separation is parallel to the longitudinal axis of the index finger.

In one embodiment, the index finger plectrum 121 is permanently fixed to the rigid material. The permanent fixture is in one embodiment by way of being integrally formed with the rigid material of the index finger.

In another embodiment, the index finger 120 of the glove comprises a slot 125 in the tip 123 through which the index finger pick plectrum 121 pokes through. The index finger pick plectrum 121 connects to a rigid portion inside the glove index finger. In one embodiment, the rigid portion is permanently fixed to the inside of the glove index finger; and in another embodiment, it is integrally form and/or moulded with a soft flexible portion of the glove index finger.

Preferably the groove and/or the slot length is longer than the length of the portion of the plectrum in the groove and/or slot to allow the musician to move the plectrum along the groove and/or slot to an ideal position for playing a stringed instrument.

An embodiment of the aid 100 for playing a stringed instrument comprises the glove 160 and a thumb pick as described above. The aid 100 also comprises an index finger pick comprising and index finger pick ring portion 22 and an index finger pick plectrum 21. In this embodiment, the aid may be supplied as a kit comprising the glove, the thumb pick, and the index finger pick.

The index finger pick plectrum 121 is fixed to the glove index finger so that the planar faces of the plectrum are parallel to the index fingernail of a musician wearing the glove 160.

The index finger 120 of the glove has at least one slot through the tip 123. The slot has a length and width allow the index finger pick plectrum to poke through. The length of the slot is aligned to be parallel with the plane of the palm 161, fingers 150, 140, 130, 120, and the thumb 110 of the glove when the glove is open handed as shown in FIGS. 3, 4, and 5.

In an embodiment, the index finger has two slots through the tip 123. The two slots are parallel. The length of one of the slots is aligned with the location of the tip where in use the tip of the index finger nail of a person wearing the glove located. This allows the person the glove to use the index finger pick as an extension of their index finger nail.

The two slots are separated by the inner diameter proximate the tip of the glove. This allows the person using the glove to use the index finger pick plectrum 41, 141 as an extension of the bottom of the index finger.

In an embodiment, the aid 100 is manufactured by inserting an index finger pick inside a glove 160 and into the glove index finger 120. The index finger pick ring portion 22 is seated into the tip 123 of the glove index finger. In an embodiment, the glove index finger is made comprising a material that is stretchable and it is made with an unstretched diameter that is smaller than an outer diameter of the ring portion 22. The glove index finger stretchable material is stretched over the ring portion 22. The ring portion is thereby held snug in the tip of the glove index finger.

The index finger pick plectrum 21, 121 is a rigid chip of planar material which is fixed by a rigid connection to the index finger ring portion 22. In an embodiment, the aid 100 is manufactured by inserting the index ring finger pick plectrum through a slot in the tip 123 of the glove index finger 120. The index finger ring portion 22 is seated snuggly inside the glove index finger.

The index finger pick plectrum 21, 121 held in position by being fixed to the ring portion 22. Hence the position of the index finger pick plectrum 21, 121 is held fixed relative to the position of the thumb pick plectrum 11, 111.

A musician pulls the glove on to their hand. Then both the index finger pick plectrum and the thumb pick plectrum are positioned on the musician's hand for playing a stringed instrument. The musician does not have to grip a plectrum between their thumb and an index finger. The musician does not have to place ring portions separately on their thumb and index finger and turn them separately to position the index finger pick plectrum and thumb pick plectrum to play a stringed instrument because pulling the glove onto the hand places the thumb and index finger plectrums in position.

In another embodiment, the index finger 120 comprises a rigid portion. The rigid portion encircles or partially encircles the glove index finger so that when the glove is worn the rigid portion is held snuggly to the index finger. The aid 100 is made by fixing the index finger pick plectrum 121 by means of a rigid connection to the rigid portion of the glove index portion. In one embodiment, the means of rigid connection is a groove in the rigid portion. The groove is slightly less wide than thickness of plectrum so that the plectrum is held fixed in the groove for playing a stringed instrument. The plectrum 121 is detachable from the glove index finger 120 deliberately removing if from the groove.

FIGS. 3, 4, and 5 also show a glove middle finger plectrum 131 extending longitudinally from the tip 133 of the glove middle finger; and they show a glove ring finger plectrum 141 extending longitudinally from the tip 133 of the glove middle finger.

The middle finger plectrum 131 and the ring finger plectrum 141 are manufactured into the glove 160 in the same manner as described above for the index finger plectrum 121. The middle finger plectrum 131 and ring finger plectrum 141 are oriented parallel to the fingernail of the glove wearer as described above for the index finger pick plectrum.

Hence a musician merely has pull the glove onto their hand to simultaneously grip and orientate the thumb pick plectrum 111, the index finger pick plectrum 121, the middle finger pick plectrum 131, and the ring finger pick plectrum 141 so that all the plectrums are held on the musician's thumb and fingers ready to play a stringed instrument.

Some musical stringed instruments are played by strumming the strings while the musician holds their index finger pinched against their thumb. FIG. 6 shows a glove of the invention held in this manner. Many musicians prefer to strum the strings with the thumb pick plectrum 111, however as can be seen in FIG. 6 the index finger plectrum 121 will interfere with the strings which are strummed by the thumb pick plectrum. This is because with the index finger tip 123 pinched adjacent the thumb tip 113 the index finger plectrum and the thumb tip plectrum both extend about the same distance away from the pinched tips.

Figure 7:
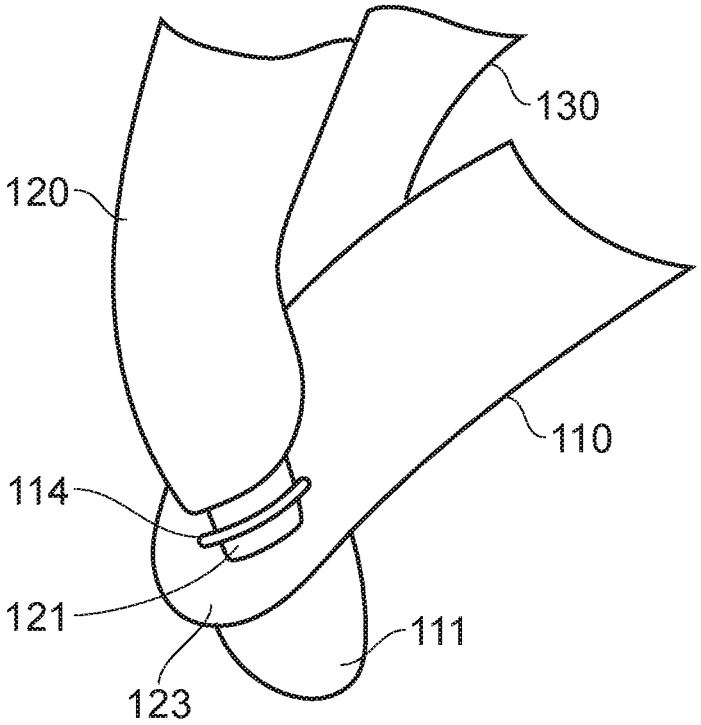
FIG. 7 is a view of the aid for playing a stringed instrument held with index finger plectrum held in thumb loop according to the invention.

A means to overcome the problem of the index finger plectrum interfering with the strings of the musical instrument is shown in FIG. 7. The means is a strap 114 having ends fixed on the thumb print side of the glove thumb 110. The strap is fixed proximate the glove thumb tip. The strap is aligned so that lengthwise it is substantially parallel to the longitudinal direction of the glove thumb. In another embodiment, the strap is aligned at an angle between parallel and forty-five degrees to the longitudinal direction of the glove thumb. The length of the strap is longer than the width of the index finger plectrum so as to receive and hold the index finger plectrum against the glove thumb tip as shown in FIG. 7. The index finger plectrum is thereby prevented from interfering with the strings as the musician strums the strings with the thumb plectrum 111.

The thumb print side of the glove thumb tip comprises a first component of a clasp 114 and the glove index finger tip comprises a second component of a clasp which is the index finger plectrum 121, to hold the glove thumb tip and index finger tip clasped tip to tip.

Another embodiment of the means for preventing the index finger plectrum interfering with the strings of the musical instrument is shown in FIG. 3. The means comprises: a prong 124 extending from the index finger plectrum 121, and a long channel 114 or a circular hole in the glove thumb 110 to receive the prong. The slot is located proximate the thumb tip and aligned from parallel to the thumb longitudinal direction to forty-five degrees from the longitudinal direction. The prong is ideally circular so that the prong turns freely in the long channel 114 or hole with circular wall according to a position comfortable for the musician with their index finger tip against their thumb tip.

In another embodiment, the prong comprises a ball shaped element on the tip which clasps in a matching socket in a ball and socket type of connection with a rotational degree of freedom and a rocking degree of freedom so that the musician is free to rotated and rock the connected glove thumb and index finger to a comfortable playing position.

In another embodiment, the prong is fixed to the thumb print side of the glove thumb and the socket is formed in the finger print side of the glove index finger.

In an embodiment, the glove thumb comprises a second thumb plectrum 117 parallel the thumb plectrum 111 previously described. Thus, the glove thumb comprises a pair of thumb plectrums 111, 117. The second thumb plectrum 117 pokes through a second slot 116 parallel to the first slot 115. Alternatively, the second thumb plectrum is connected to the rigid portion located proximate thumb tip via a groove in a flexible portion of the glove thumb as described above. Hence the musician is able to play a string twice with a single strum which produces a different sound to a single play of the string.

In another embodiment shown in FIG. 8 both the glove thumb and the glove index finger comprise a pair of parallel plectrums for playing strings twice with a single strum.

Figure 9:
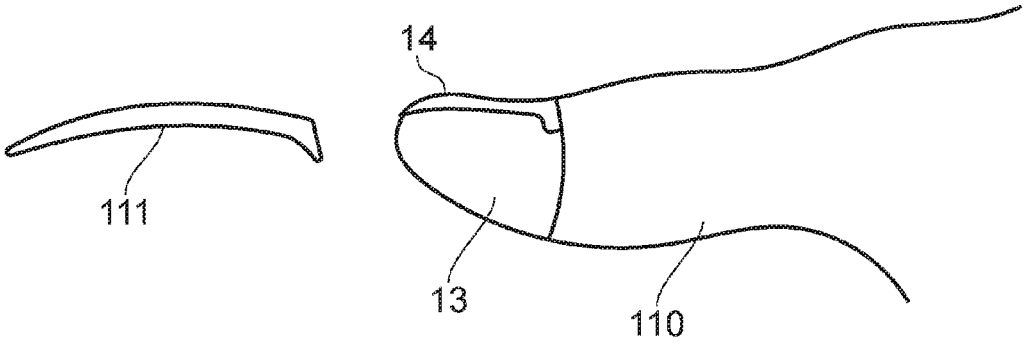
FIG. 9 is a view of the aid for playing a stringed instrument comprising a rigid first portion in the form of a thumb thimble.

In FIG. 9 an embodiment is shown a view of the first digit being the thumb 110 of the glove 160. The first rigid portion 13 comprises a thimble. The thimble is attached to the external surface of a flexible layer of cloth or skin of the thumb 110. The first rigid portion 13 comprises a first connection means 14 located on the thimble at the glove thumb tip. In use the first connection means 14 covers the user's thumb nail. The first plectrum 110 is the thumb plectrum shown in FIG. 9 disconnected from the first rigid portion 13. The thumb plectrum 110 is rigidly connectable to the rigid portion 13 by the first connection means 14.

Figure 10A:
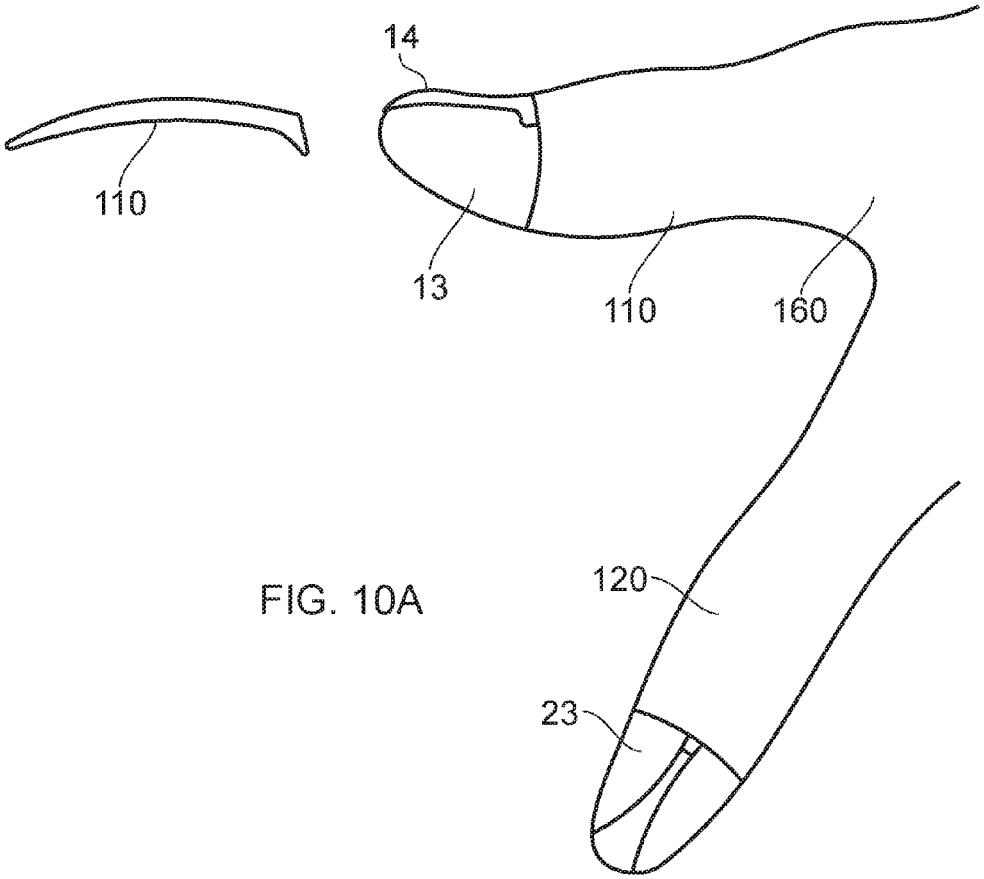
FIG. 10A is a view of the aid for playing a stringed instrument comprising a rigid first portion on a glove thumb and a rigid second portion on a glove finger.

In FIG. 10A, a first digit 110 and a second digit 120 of the glove 160 are shown. Fixed to the tip ends of the first and second digits are a first rigid portion 13 on the tip of the thumb 110 and second rigid portion 23 on the tip of the index finger 120. A side view of a first plectrum 111 is shown disengaged from the first rigid portion.

Figure 10B:
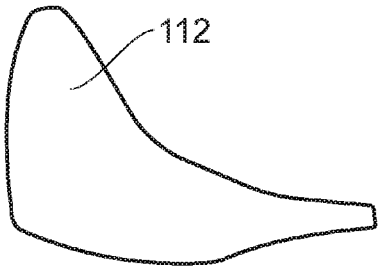
FIG. 10B is a plan view of the thumb plectrum in FIG. 10A.

In FIG. 10B, a plan view of a first design of the first plectrum 111 is shown. The first plectrum has a forward flap 118 which extends away from the distal end of the plectrum which connects to the first connection means 14, and so extends forward from the tip of the first digit when the first plectrum is connected to the first digit. The first plectrum also has a sideways flap 119 intermediate the forward flap 118 and the distal end of the plectrum. When the plectrum is connected to the connection means 14, the sideways flap extends sideways from the first digit. Both the forward flap 118 and the sideways flap 119 extend parallel to the plane of the glove 160 when the glove is open flat.

Figure 10C:
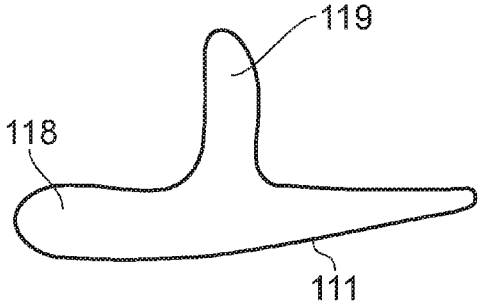
FIG. 10C is a view of an alternative design of the thumb plectrum in FIG. 10A.

In FIG. 10C a plan view of second design of the first plectrum is shown. The second design has a distal end similar the first design. The second design has a corner flap 112 which extends sideways like sideways flap 119. However, corner flap 112 is located at a distal corner from the distal end of the plectrum.

Figure 11:
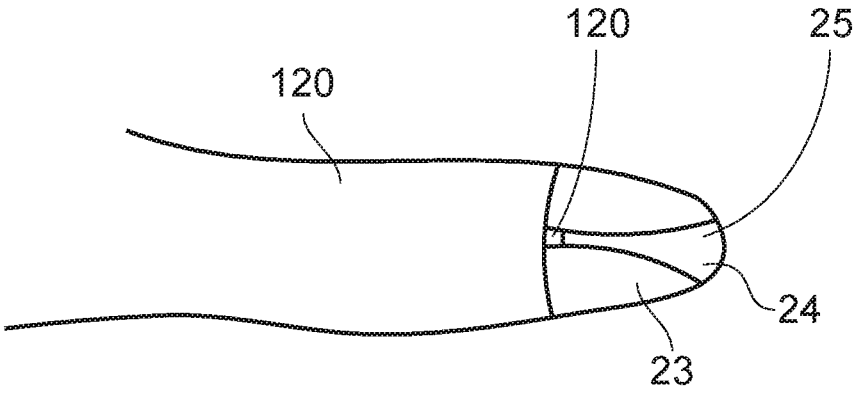
FIG. 11 is a view of a rigid first or second portion on digit.

In FIG. 11 a digit 120 of the glove index finger is shown. At the tip of the digit is a rigid portion 23 in the form of a thimble 13. The rigid portion comprises a connection means 24. The connection means comprises a groove which has a slide part 25 and a pit part 26. The pit part 26 of the groove is adjacent the rim of the thimble an is a pit which penetrates deep or through the thimble 13. The slide part 25 is smooth walled and extends from the pit part 26 to the tip of the thimble. The slide part 25 has the same width as pit part where the slide part and pit part meet. The slide part widens towards the tip of the thimble so that the slide part is widest at the tip of the thimble 13.

Figure 12:
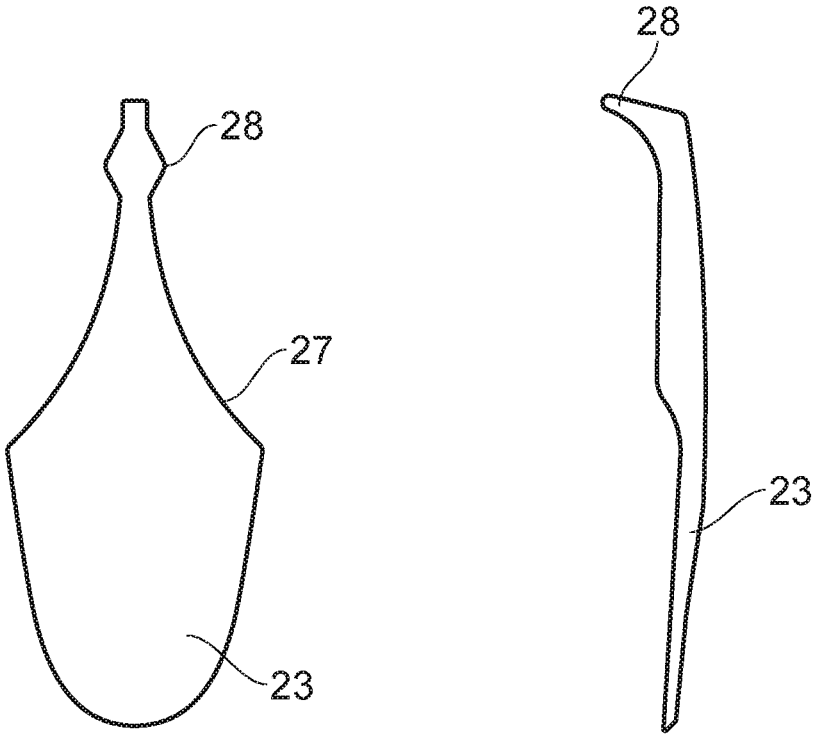
FIG. 12 is a view of a plectrum arranged to connect to the rigid portion shown in FIG. 11.
Figure 13:
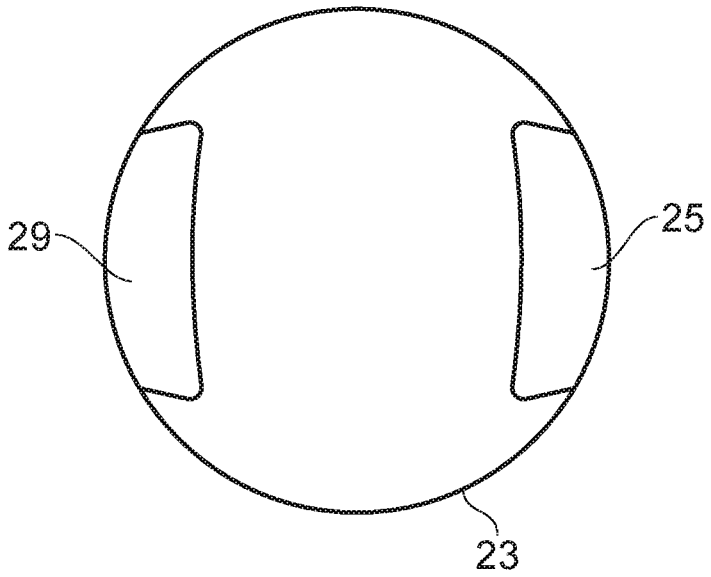
FIG. 13 is a view of a cross section through the longitudinal axis of the rigid portion.

FIG. 12 shows a design of a plectrum 23 shaped to conform with and rigidly connect to the connection means 24 of the rigid portion 13. This design of plectrum is suitable for connection to a thimble shaped rigid portion on any digit of the glove, whether finger or thumb.

The slide joining part 27 of the plectrum is located the opposite end from the forward flap part of the plectrum. The slide joining part extends from the end of the plectrum furthest from the forward flap to the forward flap. The slide joining part is narrowest at the end furthest from the forward flap. It widens in register with the widening of the connection means groove slide part 25 on the rigid portion shown in FIG. 11. The slide joining part merges with the pit joining part 28 located at the end of the plectrum furthest from the forward flap. The pit joining part 28 comprises a spike extending away from the plane of the forward flap. The pit joining part has dimensions to register contact with the groove pit part 25 in the rigid portion.

The plectrum 23 is rigidly connected to the connection means of the rigid part by placing the plectrum slide joining part 27 into register contact with the groove slide part 25, and by placing the plectrum pit joining part 28 contact with the groove pit part 26.

The rigid portion of the index digit 23, which as the rigid portion of the thumb digit 13, has connection means including groove slide parts 25, 29 on opposite sides of the circumference. There are thereby connection means for the plectrum on opposite sides of the digit. In use the musician places the plectrum on the side of the digit that is most convenient for playing their instrument.

Figures 14A, 14B:
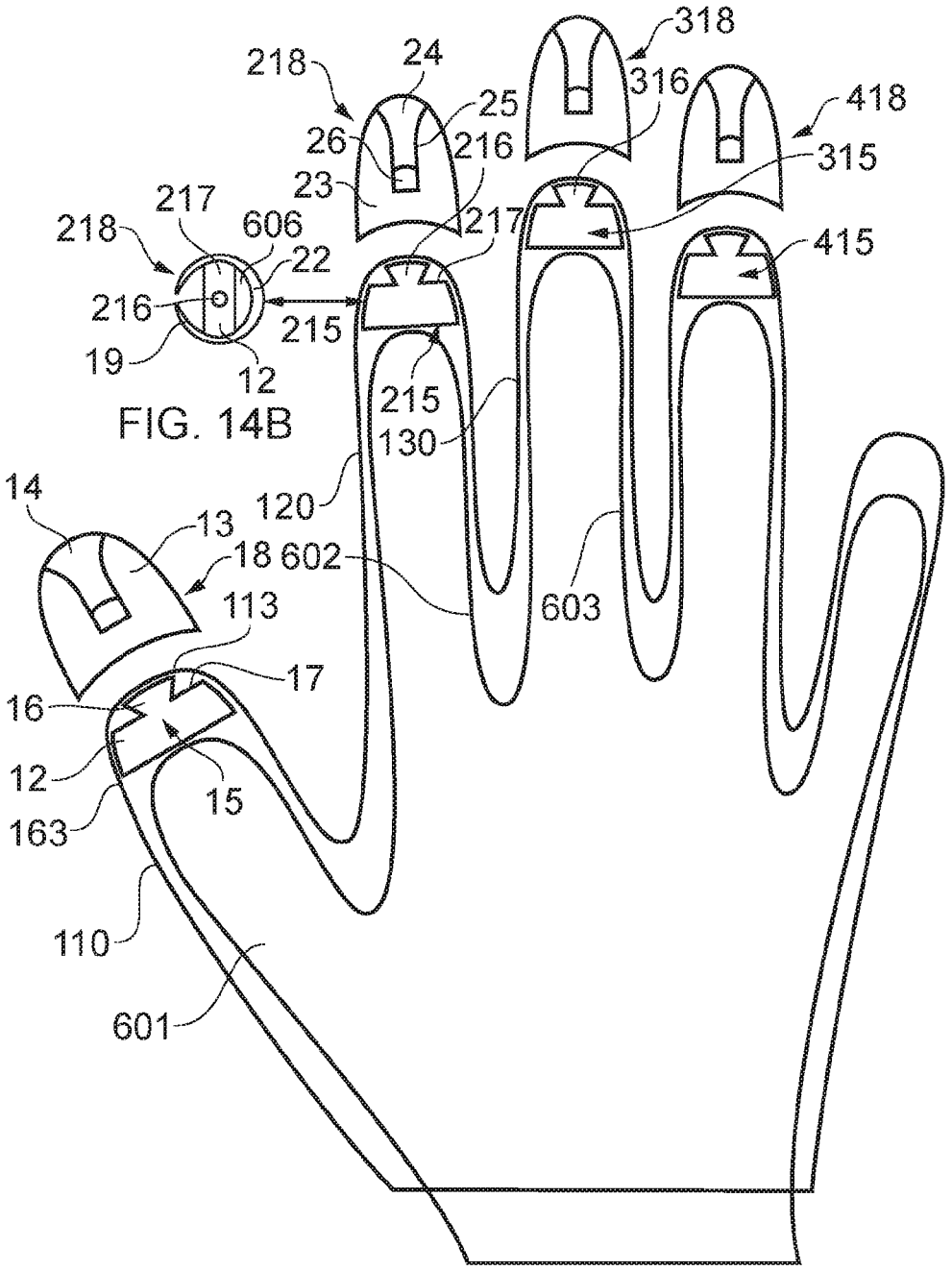
FIGS. 14A and 14B are views showing user's hand as it is inserted into a glove for holding plectrum's fast to the user's thumb and fingers.

FIG. 14A illustrates a user's thumb 601, and index 602, middle 603, and ring 604 fingers inside the glove. A flexible layer of cloth or material 163 forms a major portion of the palm, back, thumb 110, and fingers 120, 130, 140, 150 of the glove.

FIG. 14A also illustrates the rigid portion disassembled into internal module 15, 215, 315 and an external module 18, 218, 318, 418.

As FIG. 14A shows, the rigid portion internal modules 15, 215, 315, 415 are inside the glove thumb 110 and fingers 120, 130. The flexible layer of cloth 163 is stretched over the internal module 15, 215,315 thereby fixing the internal module to the glove thumb and fingers in a set orientation.

The thumb rigid portion internal module 15 comprises a modules connecting means 16 to rigidly connect to a thumb rigid portion external module. When internal and external modules are assembled, the thumb rigid portion is a single rigid unit. The single unit rigidly connects to the thumb pick plectrum thereby fixing the thumb pick plectrum in a set orientation with respect to the layer of cloth or material 163, and thereby a set orientation with respect to the glove palm, back, thumb, and fingers.

The thumb rigid portion internal modules connecting means 16 extends forward from a thumb rigid portion internal module thumb tip stop 17. The thumb tip stop 17 is connected to the forward edge of the ring portion 12 which surrounds the user's thumb 601.

The internal modules connecting means 16 extends though the layer of cloth or material to connect to the thumb rigid portion external module 18. The external module is thereby rigidly connected to the internal module and in use held tight the user's thumb. The plectrum is rigidly connected to the external module by the thumb pick connection means 14 which the external module comprises. By a user wearing the glove, the plectrum is effectively held tight to the user's thumb by the internal module rigid connection means 16 and thumb pick connection means 14. Both connection means act together as joined rigid connection means.

The ring portion extends beyond the part of the forward edge connected to the thumb tip stop 17. The where the ring portion extends beyond, there is a thumb pick clip comprising the free ends of the ring portion. The clip assists the ring portion to hold tight over the user's thumb when the glove is worn.

FIG. 14A shows that the index finger, middle finger, and ring finger of the glove comprise an index 215, middle 315, and ring finger rigid portion internal module respectively. These rigid portion internal modules comprise a ring portion, clip, and finger tip stop the same as the thumb rigid portion internal module.

FIG. 14B shows a front view of the index finger rigid portion internal module. The tip stop 217 covers the centre of the ring portion. The tip connects to diametrically opposite sides the ring portion. Intermediate the tip stop and the side of the ring portion, there is a gap 606 through the ring portion. The gap is a slot for the user's thumb nail or fingernail.

The internal module is substantially thimble shaped. The internal module is comfortable to wear with the user's finger or thumb tip against the tip stop without pressing against the tip of the user's fingernail or thumb nail.

Free ends of the ring portion are located on the opposite side of the tip stop for the gap. From the free ends to the tip stop, the ring portion is springy. From the free ends to the tip stop of the ring portion is an effective part of the clip because the free ends spring against the user's thumb or finger. The ring portion is thereby held tightly to the user's thumb or finger.

Figure 15C:
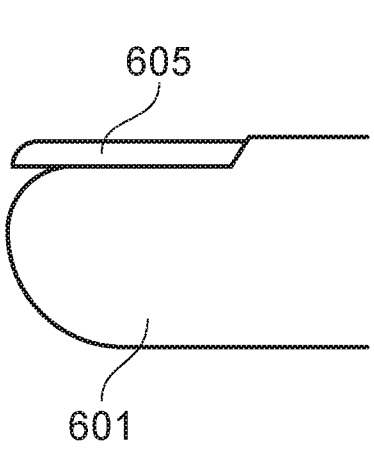
FIGS. 15A, 15B, and 15C are front and side views on an internal module.
Figure 15B:
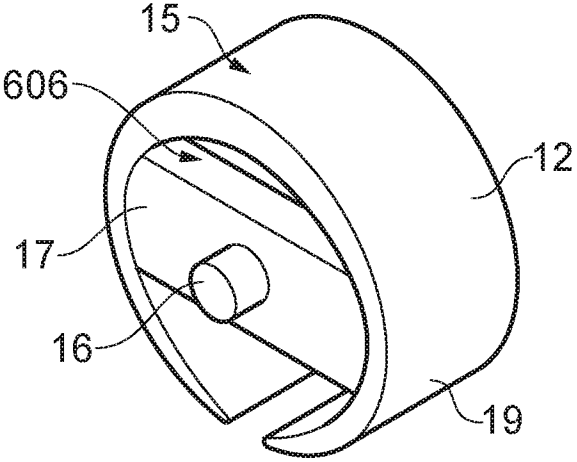
Figure 15A:
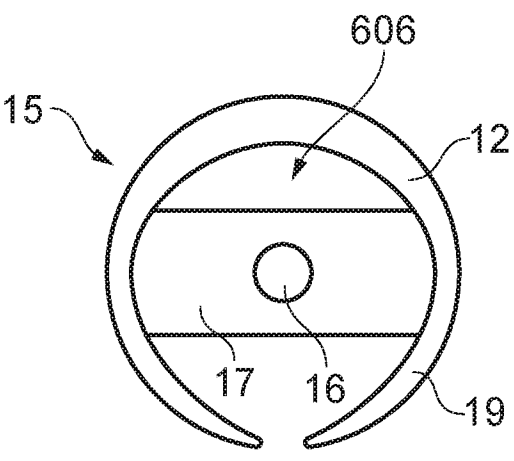

A close up front view and side view of the internal module 15 are shown in FIGS. 15A and 15B. FIG. 15C illustrates the position of the user's thumb to be inserted into the internal module.

The invention has been described by way of examples only. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the claims.

INDEX OF LABELLED FEATURES IN THE FIGURES

Thumb pick plectrum . . . 11
Thumb pick ring portion . . . 12
Thumb pick rigid portion . . . 13
Thumb pick connection means . . . 14
Thumb rigid portion internal module . . . 15
Thumb rigid portion internal module rigid connection means . . . 16
Thumb rigid portion internal module thumb tip stop . . . 17
Thumb rigid portion external module . . . 18
Thumb pick clip . . . 19
Index finger pick plectrum . . . 21
Index finger pick ring portion . . . 22
Index finger rigid portion . . . 23
Index finger pick connection means . . . 24
Index finger groove (slide part) . . . 25
Index finger groove (pit part) . . . 26
Index finger pick plectrum slide joining part . . . 27
Index finger pick plectrum pit joining part . . . 28
Index finger rigid portion internal module . . . 215
Index finger rigid portion internal module rigid connection means . . . 216
Index finger rigid portion internal module index finger tip stop . . . 217
Index finger rigid portion external module . . . 218
Middle finger pick plectrum . . . 31
Middle finger pick ring portion . . . 32
Middle finger rigid portion internal module . . . 315
Middle finger rigid portion internal module rigid connection means . . . 316
Middle finger rigid portion external module . . . 318
Ring finger pick plectrum . . . 41
Ring finger pick ring portion . . . 42
Ring finger rigid portion, rigid connection means . . . 49
Aid for playing a stringed instrument . . . 100
Glove Thumb . . . 110
Glove Thumb pick plectrum . . . 111
Glove Thumb pick plectrum corner flap . . . 112
Glove Thumb, tip of thumb . . . 113
Glove Thumb strap . . . 114
Glove Thumb slot . . . 115
Glove Thumb second slot . . . 116
Glove Thumb second pick plectrum . . . 117
Glove Thumb pick plectrum forward flap . . . 118
Glove Thumb pick plectrum sideways flap . . . 119
Glove Index finger . . . 120
Glove Index finger pick plectrum . . . 121
Glove Index finger, tip of finger . . . 123
Glove Index finger prong . . . 124
Glove Index finger slot . . . 125
Glove Index finger second slot . . . 126
Glove Index finger second pick plectrum . . . 127
Glove Middle finger . . . 130
Glove Middle finger pick plectrum . . . 131
Glove Middle finger, tip of finger . . . 133
Glove Ring finger . . . 140
Glove Ring finger pick plectrum . . . 141
Glove Ring finger, tip of finger . . . 143
Glove Little finger . . . 150
Glove . . . 160
Glove Palm . . . 161
Glove Back side . . . 162
Glove Flexible layer of material . . . 163
User's Thumb . . . 601
User's Index Finger . . . 602
User's Middle Finger . . . 603
User's Ring Finger . . . 604
User's Thumb Nail . . . 605
Gap in Rigid Portion for User's Nail . . . 606

The invention claimed is:

1. An aid for playing a stringed musical instrument comprises: a glove adapted to be worn over a user's thumb and at least one finger, the glove has a first rigid portion having a first rigid connection means for a first plectrum and a second rigid portion having a second rigid connection means for the first plectrum or a second plectrum, the first rigid portion at least partially encircles the user's thumb and the second rigid portion at least partially encircles the one finger when worn.

2. An aid according to claim 1 wherein the glove comprises the first plectrum rigidly connected by the first rigid connection means to the first rigid portion.

3. An aid according to claim 2 wherein the glove comprises the second plectrum rigidly connected by the second rigid connection means to the second rigid portion.

4. An aid according to claim 1 wherein the first rigid portion and second rigid portions comprise first and second clips respectively including free ends of the ring portion by which the first and second rigid portions are in use held tight to the user's thumb and finger.

5. An aid according to claim 1 wherein a flexible layer of cloth or material which forms a flexible layer of the glove stretches over the first rigid portion fixing the rigid portion to the interior surface of the flexible layer.

6. An aid according to claim 5 comprising a slot through the flexible layer through which the plectrum passes when connected to the first rigid connection means.

7. An aid according to claim 4 wherein the first rigid connection means comprises a groove in the first rigid portion to receive the first plectrum.

8. An aid according to claim 7 wherein the first clip is adapted to align the groove in the first rigid portion with the longitudinal direction of the user's thumb when the clip holds the first rigid portion snugly thereon.

9. An aid according to claim 8 wherein the first plectrum when connected to the first rigid portion extends in a plane parallel to the plane of the glove when the glove is open flat.

10. An aid according to claim 9 wherein the first clip is included in a thimble.

11. An aid according to claim 1 wherein the first rigid portion and second rigid portion comprise a first and a second component of a clasp respectively for holding the thumb and finger at least partially encircled by the rigid portions tip to tip.

12. An aid according to claim 5 wherein the rigid portion comprises an internal module over which the flexible layer of cloth or material is stretched, and an external module exterior to the flexible layer and rigidly connected to the internal module, wherein the external module comprises the first rigid connection means.

13. A method of manufacturing an aid for playing a stringed musical instrument, includes steps of: selecting a glove comprising a flexible layer with a first digit which is a finger or the thumb of the glove; selecting a rigid first portion rigidly connected to a first plectrum by a first connection means, wherein the rigid first portion comprises a clip to snugly encircle or partially encircle a user's finger or thumb; inserting the rigid first portion, first plectrum and first clip into the first digit so that the first plectrum protrudes through the flexible layer of the first digit.

14. A method of manufacture of an aid for playing a musical stringed instrument, including: selecting a glove comprising a flexible layer with a first digit which is a finger or the thumb of the glove; and selecting a rigid first portion comprising a first connection means, wherein the rigid first portion comprises a first clip to snugly encircle or partially encircle a user's finger or thumb; inserting the rigid portion, first connection means, and first clip into the first digit; and rigidly connecting a first plectrum to the rigid first portion so that the first plectrum protrudes through the flexible layer of the first digit into the first connection means.

15. A method according to claim 14 wherein the flexible layer comprises a resilient flexible skin or cloth and stretching the skin or cloth over the rigid first portion to grip the first rigid first portion.

16. A method according to claim 13 wherein the flexible layer comprises a resilient flexible skin or cloth and stretching the skin or cloth over the rigid first portion to grip the first rigid first portion.

* * * * *